US005342144A

United States Patent [19]

McCarthy

[11] Patent Number: 5,342,144

[45] Date of Patent: Aug. 30, 1994

[54] STORMWATER CONTROL SYSTEM

[76] Inventor: Edward J. McCarthy, 14816 SE. 116th St., Renton, Wash. 98059

[21] Appl. No.: 970,476

[22] Filed: Nov. 2, 1992

[51] Int. Cl.[5] ..... E02B 7/20; E02B 13/00

[52] U.S. Cl. ..... 405/39; 405/36; 405/92

[58] Field of Search ..... 405/36, 37, 39, 40, 405/87, 92; 137/236.1

[56] References Cited

U.S. PATENT DOCUMENTS

| | | | |
|---|---|---|---|
| 4,332,507 | 6/1982 | Wakamori et al. | 405/92 |
| 4,498,809 | 2/1985 | Farmer | 405/92 |
| 4,522,534 | 6/1985 | Wakamori et al. | 405/37 |
| 4,604,681 | 8/1986 | Sakashita | 405/92 X |
| 4,892,440 | 1/1990 | Regan | 405/36 |
| 5,067,850 | 11/1991 | Gray | 405/92 |

*Primary Examiner*—David H. Corbin

*Attorney, Agent, or Firm*—J. Michael Neary

[57] ABSTRACT

Stormwater from a watershed is collected in a stormwater collection basin for water quality improvement primarily by settling of suspended solids, and also for control of the flow rate through downstream flow channels. The outflow rate from the basin is governed by an adjustable water control device such as a gate valve operated by a motor under control of a microprocessor in accordance with predetermined conditions as sensed by sensors such as basin water level sensors, upstream flow or rainfall sensors, and flow rate sensors downstream of the basin. The effective capacity of the basin is increased by the ability to interactively adjust the flow rate from the basin based on sensor inputs indicative of anticipated inflow rates and the flow capacity of the downstream channels and water can be retained in periods of dry weather for irrigation and the like.

26 Claims, 15 Drawing Sheets

STORMWATER CONTROL SYSTEM

BACKGROUND OF THE INVENTION

1. Field of the Invention

This invention relates to the automated control of liquid discharge from a control structure or storage reservoir, and more particularly to the controlled release of stormwater to a conveyance system from a stormwater detention reservoir or system of reservoirs by automatic adjustment of the release rate from the reservoir in order to support a variety. of water management objectives.

2. Discussion of the Problem Solved

Stormwater is water generated by rainfall and is often collected and routed into storm water management facilities to prevent downstream flooding, erosion, sedimentation and water quality degradation. Uncontrolled stormwater runoff from development, forest and agricultural activities can cause flooding, channel erosion, sedimentation and degradation of wildlife habitat and water quality.

Many urban and developed areas require stormwater management, the objectives of which include runoff rate control, erosion and sedimentation control, as well as water quality improvement. Accomplishment of these objectives is often attempted with stormwater detention reservoirs and water quality improvement structures. The term "detention reservoir," used herein, refers to a facility or structure capable of detaining, storing or withholding surface water or other liquids. This includes ponds, lagoons, below ground pipes, vaults, tanks, ditches, wetlands and tidal marshes, as well as water controlled by dams, dikes, weirs or risers.

Development can drastically change the hydrology of a site. Roads, driveways, sidewalks, roofs and lawns cause greater volumes of stormwater runoff at higher rates than under natural conditions. To control peak runoff rates from developed areas, stormwater is typically collected and routed to a detention reservoir where the stormwater is stored and released to the downstream system at a designed rate. The design release rate is often determined by the capacity of the downstream conveyance system and is frequently limited to a designated proportion of the predeveloped runoff rate. Exceeding the capacity of the downstream conveyance system can create flooding, erosion and sedimentation.

The release rate from the detention reservoir is typically controlled by a restrictor unit. Prior art restrictor units embody a flow restrictor consisting of a fixed placement flow structure such as an orifice plate, weir, gate or combination thereof. The flow restrictor is configured to release stormwater from the detention reservoir at the design release rate. Fixed placement flow restrictors are configured to discharge at the design release rate only when the detention reservoir is full. As the storage level in the detention reservoir decreases, the hydraulic head on the flow restrictor also decreases, resulting in a decrease in the release rate from the detention reservoir. Therefore, optimal use of storage volume for managing stormwater is not attained with prior art flow restrictors.

The relationship between hydraulic head and flow rate through the flow restrictor is illustrated in FIG. 1. For this illustration, the flow restrictor is a circular orifice and flow rate can be calculated with the equation:

$$Q = 3.9\, D^2 \sqrt{H}$$

Where:

Q=flow rate (cubic feet/second)

D=orifice diameter (feet)

H=hydraulic head (feet)

The flow rates for four different orifice diameters with hydraulic heads varying from 0.0′ to 10.0′ are shown in FIG. 1. The design release rate for each orifice occurs with a hydraulic head of 10.0′. For the 0.40′ diameter orifice, this rate is 2.0 CFS. With the hydraulic head at 5.0′, the flow rate for the 0.40′ diameter orifice decreases below the design release rate to 1.4 CFS. With prior art control structures, decreases in hydraulic head on the flow restrictor reduce discharge from the detention reservoir below the design release rate resulting in ineffective use of available storage volume because more storage volume is required to detain runoff from a storm than would be required if discharge from the detention reservoir were maintained at the design release rate for all storage levels.

Ineffective use of available stormwater reservoir volume increases the costs of construction projects. In King County, Washington, for example, a developed acre of land can require up to 15,000 cubic feet of detention volume for stormwater management. Construction costs of detention reservoirs range from $5–10/cubic foot of storage. The value of the real estate occupied by the stormwater management detention reservoir is an additional cost which may be far more significant than construction costs.

Many stormwater management systems, installed in developed areas over five years ago, no longer meet current regulatory stormwater management requirements. More restrictive release rates and more stringent water quality standards have increased the storage volume requirements for detention reservoirs. Some inadequate stormwater detention systems cannot be upgraded to meet current standards, due to space or economic constraints. Stormwater detention reservoirs are typically designed to detain stormwater from the contributing watershed for a storm event of a specified return interval. A 10-year storm event is a storm of magnitude which is likely to occur once every 10 years. Larger storm events statistically occur at less frequent time intervals. Storm events of 10, 50 or 100-year return intervals are commonly used for sizing detention reservoirs. Stormwater inflow in excess of the design capacity of the detention reservoir bypasses the flow restrictor through an overflow outlet.

A flow restrictor mechanism has the potential to be blocked or clogged by debris carded in the stormwater. Blockage of the flow restrictor mechanism can cause the detention reservoir to fill to capacity and then overflow. Overflow from detention reservoirs is not uncommon and results in significantly higher flow rates than those regulated by the flow restrictor.

The design of the detention reservoir and the flow control structure is typically based on analytical methods using hydrologic models. The accuracy of the models and procedures used in the design process varies. Once in place, there is typically no convenient method for adjusting the design of currently used flow restrictors to improve the operation of the system based on actual performance.

Prior art flow restrictors are always in an open position. No flexibility exists in providing increased detention time under conditions which so permit. As a consequence, prior art flow restrictors do not allow appreciable improvements in water quality through increased detention time.

Stormwater is often routed through a vegetated swale to remove pollutants from the stormwater. Vegetated swales function primarily by slowing stormwater flow velocity with increased flow resistance from the vegetation, thereby enabling suspended solids to settle. Vegetated swales have a mixed record of success in terms of effective stormwater pollutant removal. In many instances, poor pollutant removal capabilities have been attributed to short detention time and resuspension of trapped pollutants. Pollutants such as sediment, grease, oils, nitrates, phosphates, metals, coliform bacteria and pathogens can adversely alter the physical, chemical and biological properties of the environment and decrease water quality.

Water management on agricultural and forest land is commonly practiced to improve soil moisture conditions for machine operations (such as planting and harvest) and plant growth. Controlling drainage rates from agricultural and forest land is considered to be a "Best Management Practice." Controlled drainage allows water tables to be managed more precisely, providing greater control over outflow rates and improving water quality. The benefits of controlled drainage are realized offsite through reduced peak flow rates and improved water quality. Onsite benefits include improved crop yields and improved soil operability. As with stormwater management systems, prior art fixed placement flow restrictors are typically used in agricultural and forest water management applications, often limiting the flexibility of water management alternatives.

Constructed wetlands are becoming a common means to mitigate losses of natural wetlands, manage stormwater, protect coastlines from erosion and enhance wildlife habitat. The successful design and implementation of constructed wetlands depend to a large extent on the site hydrology. With prior art fixed placement flow restrictors, maintaining desired plant species composition and wetland bathymetric conditions are often difficult tasks when constructing wetlands. It has been documented that approximately half of the constructed wetlands fail, primarily due to a lack of adequate control over the hydrology. At an average cost of $70,000/acre, construction of wetlands can be a significant project expense.

Construction and rehabilitation of tidal wetlands and marshes are increasingly more common methods of protecting coastal areas from erosion and enhancing wildlife habitat. The success of tidal wetlands in supporting a desired type of vegetation and wildlife relates to the hydroperiod and tidal fluctuations of the wetland. Plant species found in high marsh ecosystems may be desired in a specific constructed tidal marsh site, but existing tidal fluctuations or hydroperiod may prevent the establishment and success of such species.

Prior art flow control structures are limited in their effectiveness in managing stormwater and achieving other water management objectives. A system is needed which has the versatility to meet a variety of stormwater management objectives including making more effective use of available reservoir storage volume, improving water quality through increased detention time, routing stormwater, controlling wetland hydroperiod and improving agricultural and forest water management. In addition, a system is needed which allows site specific adjustment and refinement of operation.

OBJECTS OF THE INVENTION

An object of the invention is to improve the methods of stormwater, agricultural, wetland and tidal marsh water management. Another object of the invention is to provide more flexible and precise control over discharge of stormwater from a stormwater detention reservoir. Still another object of the invention is to provide a more effective means than prior art in controlling the rate and sequence of stormwater discharge from a stormwater detention reservoir. Still another object of the invention is to provide a constant discharge rate from the detention reservoir as the hydraulic head on the flow restrictor decreases, thereby minimizing required storage volume. An additional object of the invention is to improve the performance of inadequately designed existing stormwater detention systems without increasing the storage capacity of the reservoir. A further object of the present invention is to increase average detention time of first-flush and low volume stormwater inflows, thereby allowing more settling of suspended solids from the stormwater and improving water quality. A still further object of the invention is to provide an improved detention method to decrease the potential for overflow from a stormwater detention reservoir, thereby minimizing the occurrence of high discharge rates. Another object of the invention is to provide a flow control system which automatically clears the flow restrictor mechanism when blocked by foreign debris, thereby reducing risk of overflow and reducing manual maintenance. Still another object of the invention is to provide a flow restrictor mechanism that can be configured on a site specific basis with computer software as opposed to the conventional process of physical lubrication, allowing the invention to be used on any site and the refinement of installations to be based on actual performance. Still another object of the invention is to collect discharge rate and storage level data for evaluating the performance of the system in meeting desired water management objectives. A further object of the invention is to provide a means for allowing the stormwater detention reservoir to be used as a storage facility for irrigation water on a seasonal basis. A still further object of the invention is to allow more flexible and precise water management in agricultural and forest drainage systems. And another object of the invention is to provide a flexible and automated means to regulate constructed wetland surface water inflow and outflow, thus controlling the hydroperiod in those wetlands. Still another object of the invention is to allow regulation of tidal fluctuation, water level and hydroperiod in tidal marshes, allowing constructed tidal marshes to function as designed in terms of providing stormwater management control, erosion protection and wildlife habitat.

SUMMARY OF THE INVENTION

According to the present invention, the foregoing and other objects are attained by providing a control system to regulate liquid flow using a mechanical system driven by microprocessor programs. The control system includes an adjustable flow restrictor mechanism, a sensor, a microcontroller, microprocessor programs and an actuator. The adjustable flow resistor mechanism physically controls liquid flow. The sensor monitors environmental parameters and sends signals to the microcontroller. The microcontroller interprets the signals and applies microprocessor programs to control liquid flow by adjusting the flow control mechanism using the actuator.

The current invention provides more flexible and precise flow control than prior art. In the application of stormwater management, the invention dictates lower storage volume requirements and provides greater detention time for storm events where water quality is of highest concern.

The current invention allows the design release rate to be maintained for all storage levels in the reservoir. This is accomplished with the interactive combination of adjustable flow restrictor mechanism, sensor, microcontroller, microprocessor programs and actuator. The adjustable flow restrictor mechanism is operated by an actuator under the control of a microcontroller using microprocessor programs and data from one or more sensors. By increasing the orifice diameter to compensate for the decreases in hydraulic head, as shown in FIG. 2, a constant flow rate can be maintained. Using a 2.0 CFS design flow rate as an example, the orifice diameter is 0.40′ when the reservoir is full. When the hydraulic head is 5.0′, the corresponding orifice diameter is 0.48′. Maintaining the design release rate for all reservoir storage levels, as in the current invention, requires less storage volume to detain runoff from a given storm in comparison to prior art flow restrictors.

The current invention provides the ability to economically upgrade existing stormwater management systems which are not operating at current regulatory standards. As previously described, the invention makes more effective use of detention reservoir storage volume, thus many existing undersized detention reservoirs could be modified to perform at current standards if retrofitted with the flow control system. With more precise flow control, as offered by the current invention, existing stormwater detention reservoirs could perform more effectively. Watersheds with stormwater management facilities having few or no features for water quality improvement could additionally benefit from the current invention.

The invention can be programmed and installed to minimize the occurrence of reservoir overflow. One method in which this can be accomplished is by implementing sensors to sense conditions indicative of the rate of change of the storage level. If the reservoir is near capacity and the rate of inflowing water is apt to create overflow conditions, the microcontroller instructs the actuator to adjust the flow restrictor mechanism to increase the rate of flow. The incremental flow released to prevent overflow is at a rate less than that likely to occur in the event of overflow.

The current invention allows the flow restrictor mechanism to clear itself of debris. When conditions indicative of debris blockage are monitored, the microcontroller instructs the actuator to oscillate the flow restrictor mechanism between the open and closed positions to dislodge debris from the flow restrictor mechanism. Alternatively, the microcontroller can routinely instruct the actuator to oscillate the flow restrictor mechanism on a calender schedule.

The current invention allows adjustment of the flow restrictor mechanism to refine initial designs based on actual performance. The microcontroller can be programmed to collect various types of data useful in evaluation of the performance of the installed invention. Data such as storage depth and corresponding flow restrictor mechanism flow area can be used to calculate discharge rate from the detention reservoir over time. Inadequacies in flow restrictor design or control logic in operating the mechanism can be identified and corrected with automated or interactive onsite programming of the microcontroller. In addition, interactive adjustment of the flow restrictor mechanism through computer software allows the same flow control system to be used for a variety of sites and conditions.

The current invention provides opportunity for greater stormwater quality improvement over conventional flow control structures and vegetated swales. Substantial gains in water quality improvement can be achieved by detaining low volume storm events and first-flush runoff volumes for longer periods of time. Longer detention time allows suspended solids in the stormwater, which carry pollutants, to settle to the bottom of the detention reservoir. First-flush runoff occurs with the onset of storm events. Longer detention of first-flush runoff is important because this stormwater carries relatively high concentrations of pollutants which have accumulated on the impermeable portions of the watershed surface since the previous storm event. The flow control system can be programmed to identify low volume storm events and first-flush runoff volumes and provide longer detention time. The invention provides longer detention time by decreasing or completely closing the flow restrictor mechanism flow area. Detention time with the current invention can be increased from a matter of hours, as with prior art, to several days. Knowledge of seasonal rainfall patterns can be used in the control logic to further improve peak runoff rate control and water quality. The invention can be installed in construction sedimentation ponds to improve the quality of water leaving the site by maximizing detention time and allowing the solids from the turbid water to settle.

The invention can be configured to turn stormwater detention reservoirs into irrigation sources. This is accomplished by closing the flow restrictor mechanism and holding back stormwater when irrigation demands are high. Water held in the storage reservoir is then available as an irrigation source for a pump driven irrigation system.

From the preceding discussion, it is evident that the present invention can improve stormwater management for an individual detention reservoir. On a district or regional scale, downstream flooding, erosion and sedimentation problems could be improved with controlled stormwater routing as provided by the current invention. A drainage basin is typically comprised of one or more contributing watersheds which combine in the downstream conveyance system. By managing stormwater from individual watersheds in coordination with one another, downstream available conveyance capacity can be used most efficiently, thus minimizing flooding and erosion hazards. A network of detention reservoir flow control systems can be linked to a central controller which monitors downstream conveyance capacity as well as available stormwater storage capacity in the network of detention reservoirs. The central controller can be programmed to schedule stormwater release. The central controller operates under the constraints of minimizing overflow in the reservoirs and not exceeding downstream conveyance capacity. Thus the central controller regulates the detention reservoir flow control systems based on the reservoirs available storage volume and the available downstream conveyance capacity.

The current invention provides more flexible and precise water management for agricultural and forest watersheds than prior an flow restrictors. One application of the current invention includes programming the microcontroller to automatically control drainage rates in a manner which will maintain improved soil moisture conditions for crop growth by automatically adjusting the level of water in the drainage ditches to a level most appropriate to the growth stage and water demands of the crop. This water level may vary seasonally and with different meteorological conditions.

The current invention allows improved control over constructed wetland inflow and outflow of water and can be used to create or reduce variations in hydrologic conditions on a site specific basis. In addition, seasonal variations in hydrology can be automatically controlled, thus ensuring that the constructed wetland will function as designed.

The current invention allows control over tidal marsh water levels, hydroperiods and tidal fluctuations. With knowledge of the tidal patterns and stage-storage relationship of the wetland site, the hydrology of the tidal wetland can be manipulated to create either a high marsh or low marsh ecosystem.

BRIEF DESCRIPTION OF VIEWS

Figure 5:
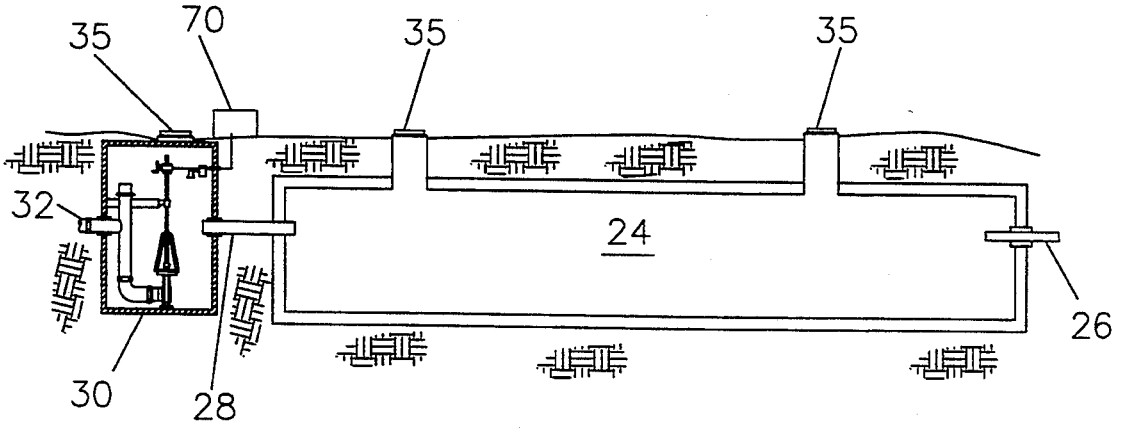
Figure 6:
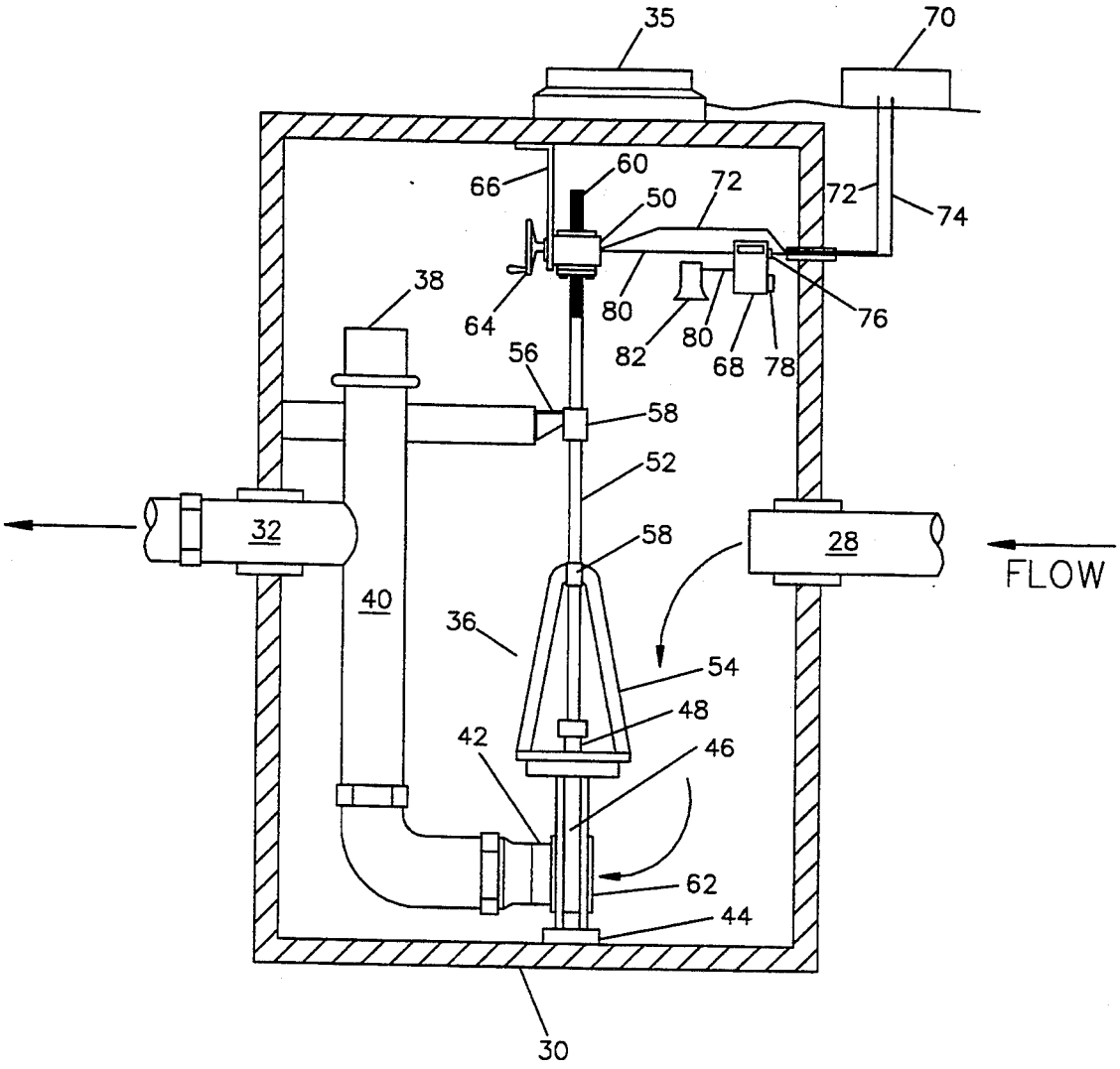

FIG. 6 presents details of the control structure and restrictor trait shown in FIG. 5.

Figure 7:
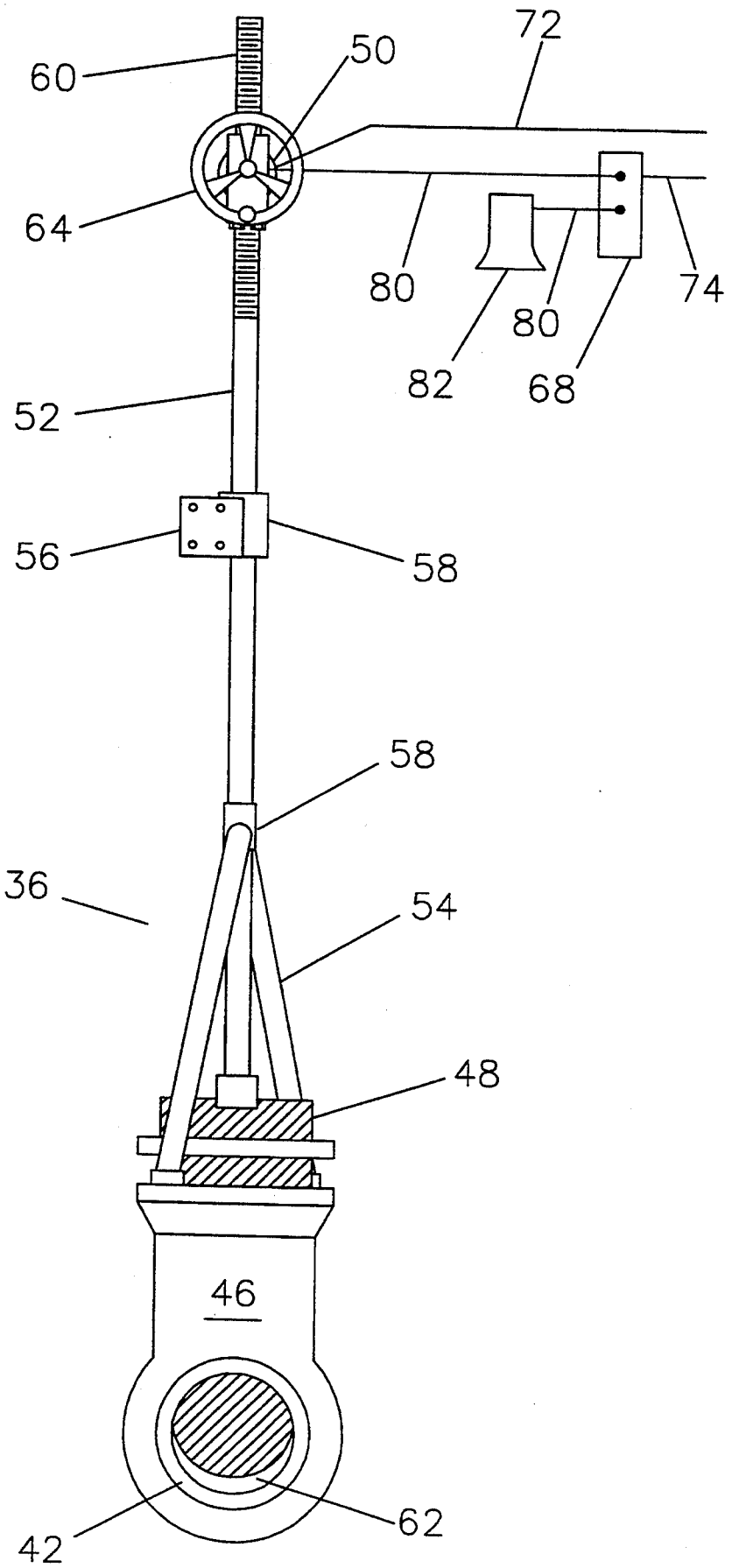
Figure 8:
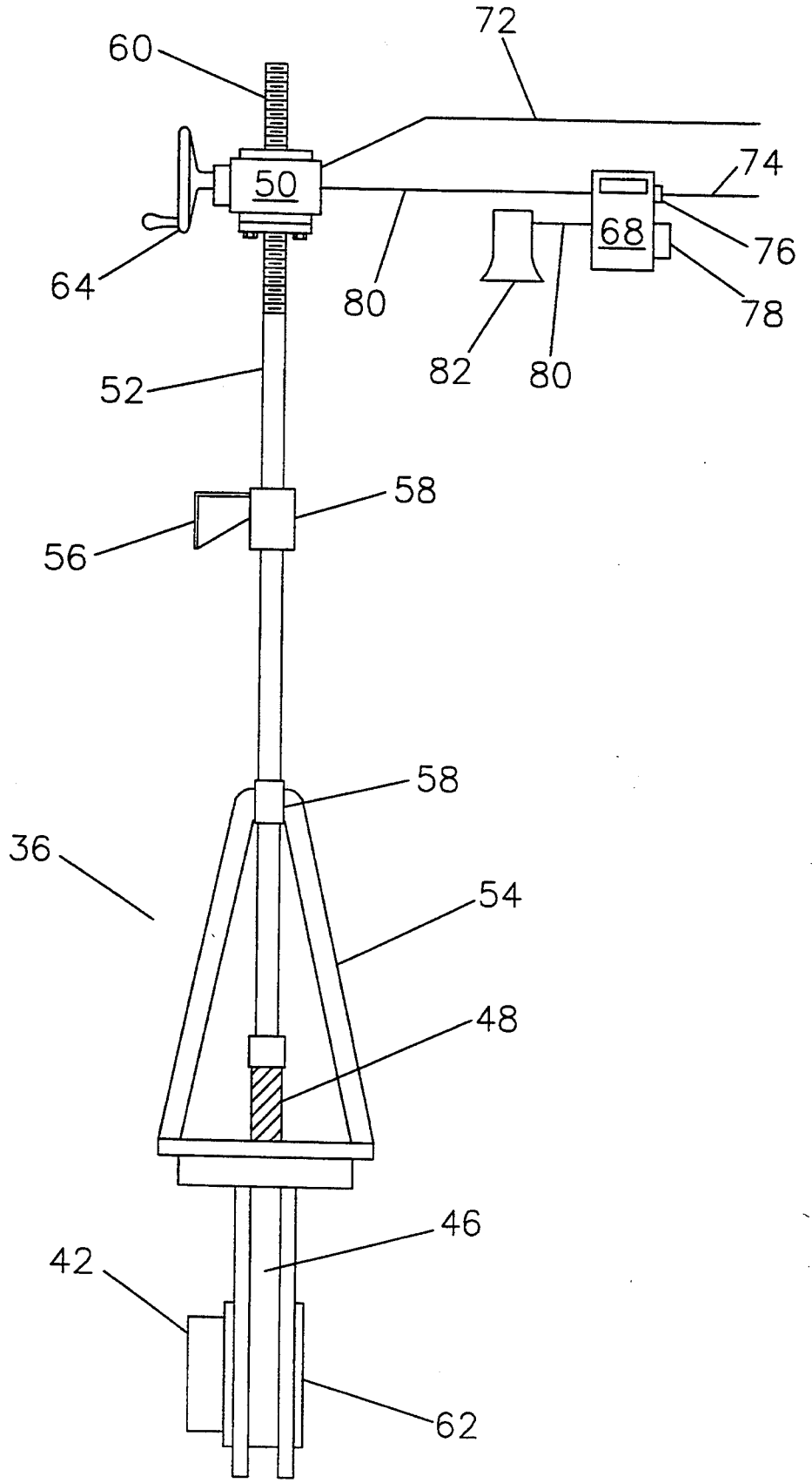

FIGS. 7 and 8 are enlarged elevations showing the adjustable gate valve for the flow control mechanism shown in FIG. 5, and also showing a sensor, microcontroller and actuator.

Figure 9:
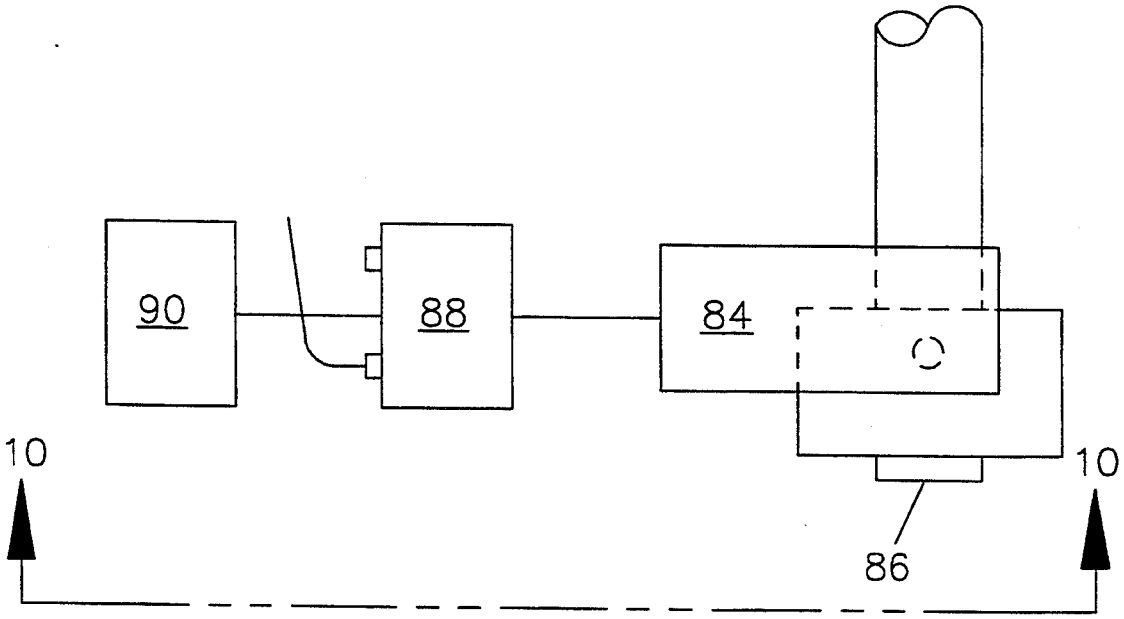
Figure 10:
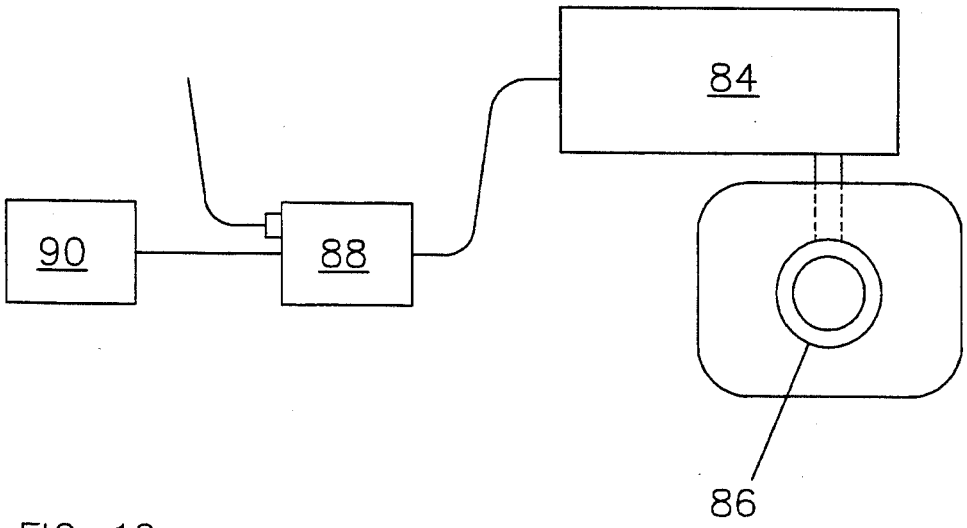

FIGS. 9 and 10 are plan and front schematic views of a generalized configuration of an alternative embodiment of the invention.

Figure 11:
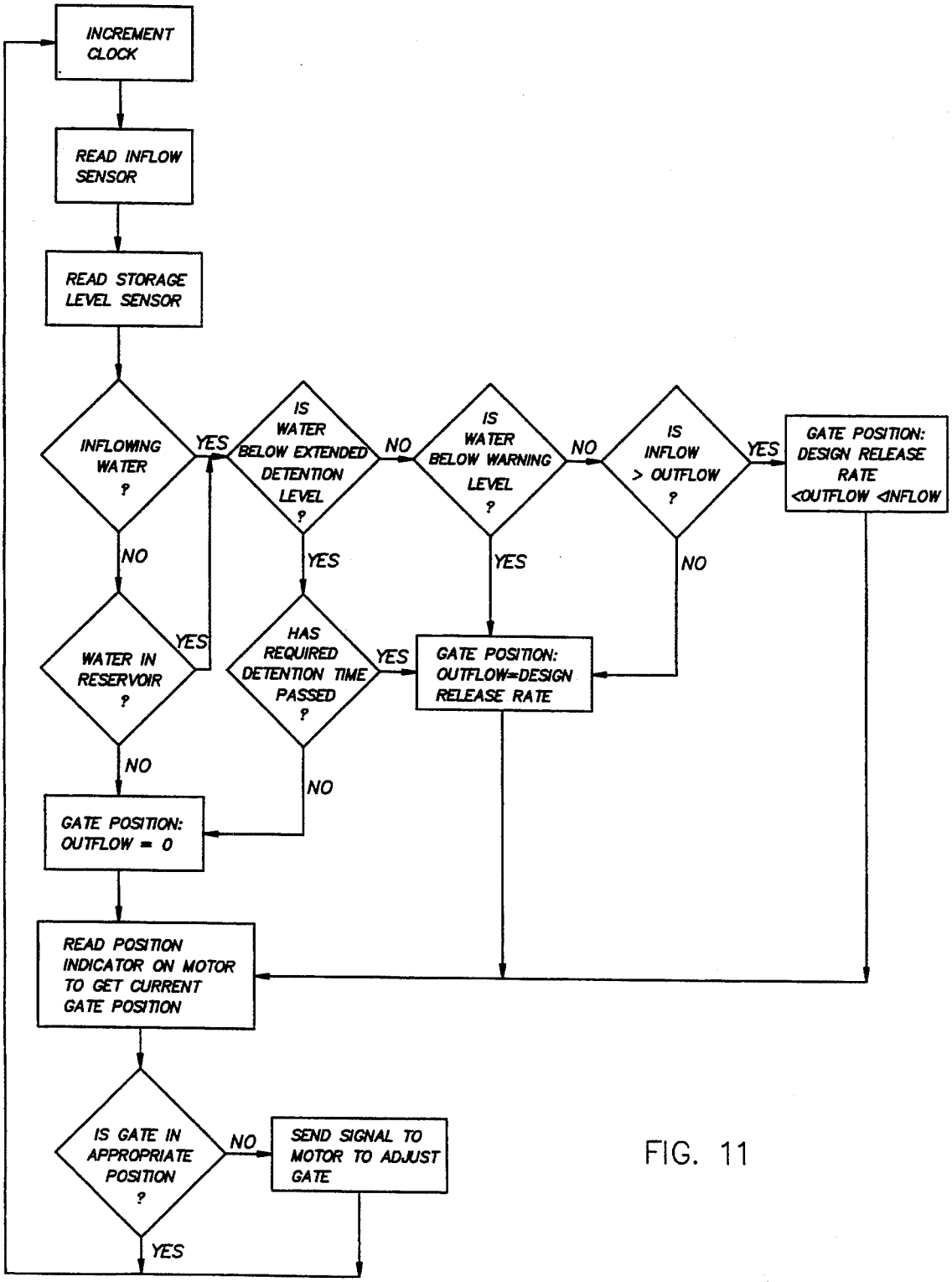

FIG. 11 is a logic diagram for flow rate control from a stormwater detention reservoir.

Figure 12:
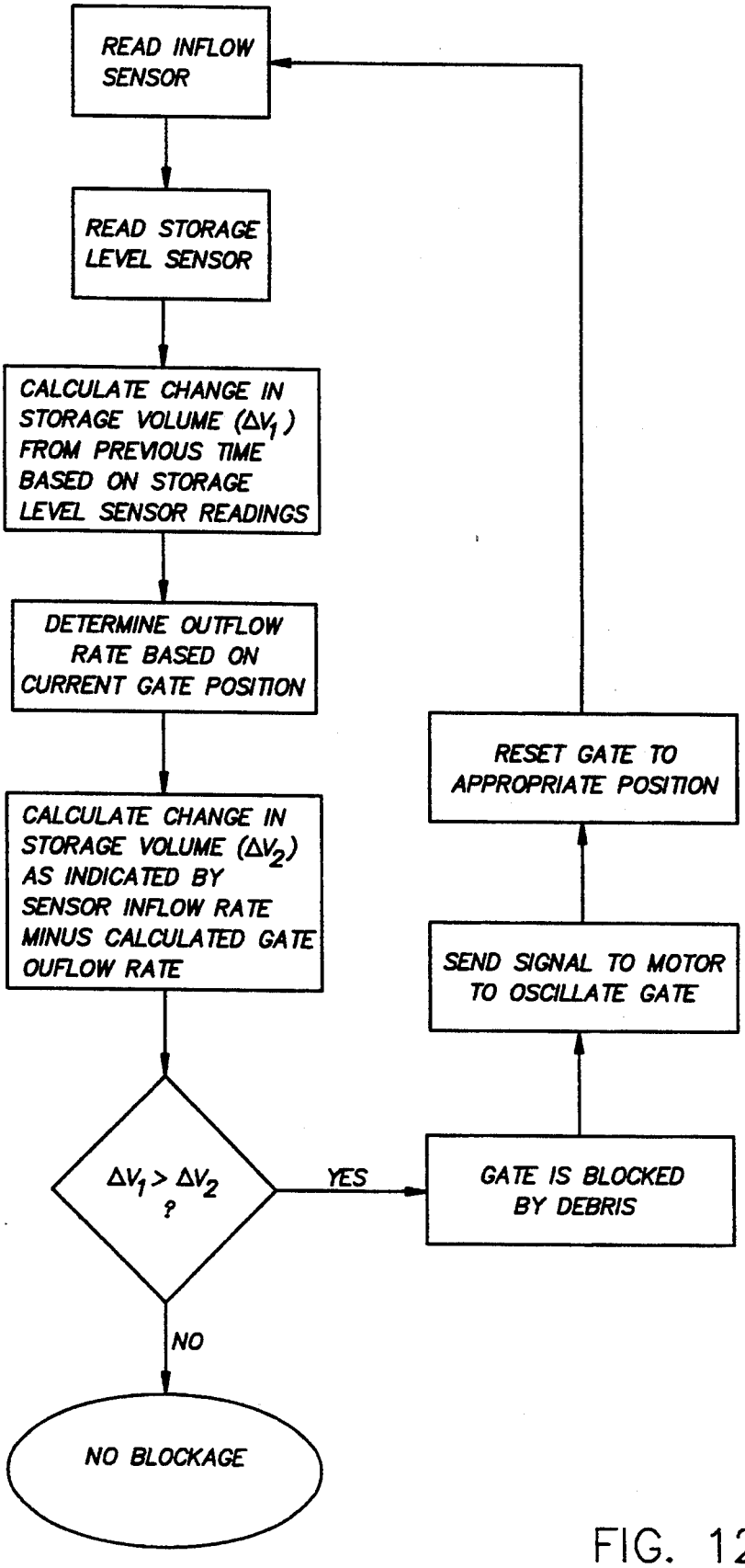

FIG. 12 is a logic diagram for automated clearing of debris from the flow control mechanism.

Figure 13:
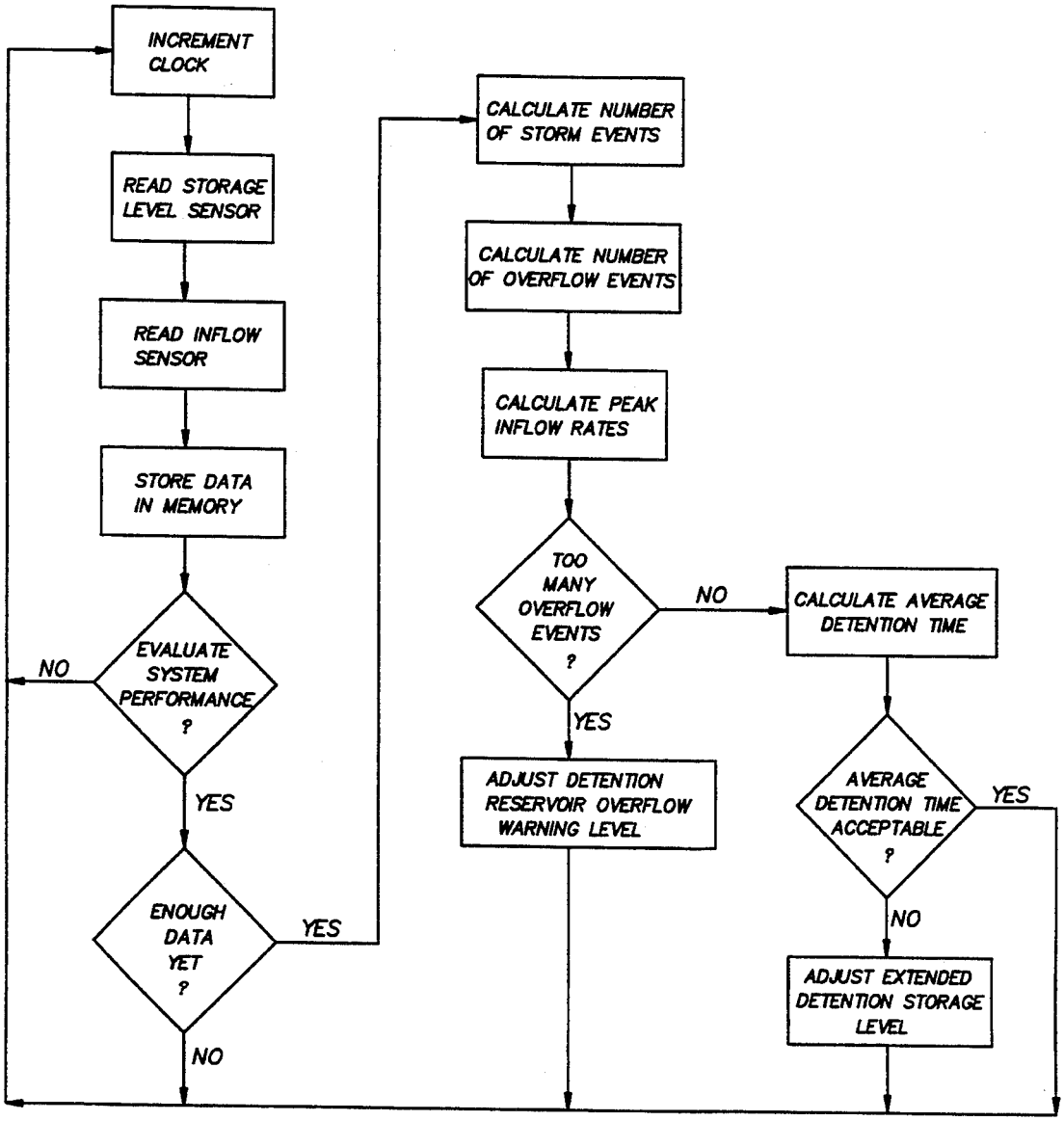

FIG. 13 is a logic diagram for data collection and automated stormwater system performance evaluation and adjustment.

Figure 14:
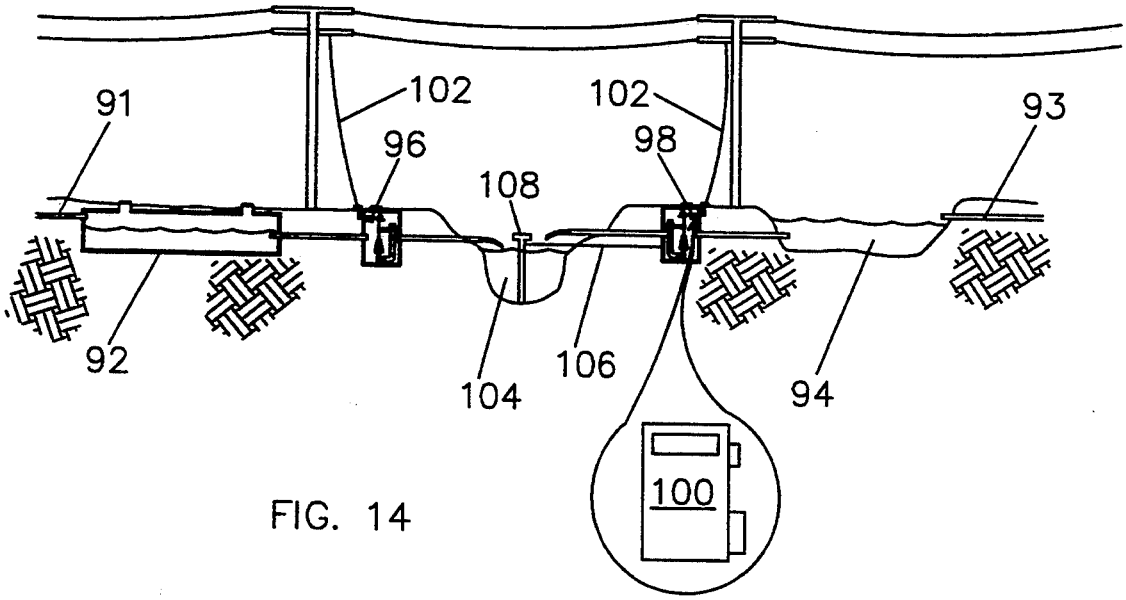

FIG. 14 is a schematic view of a region where stormwater flow to a downstream system from two separate watersheds is managed with a flood routing system according to the invention.

Figure 15:
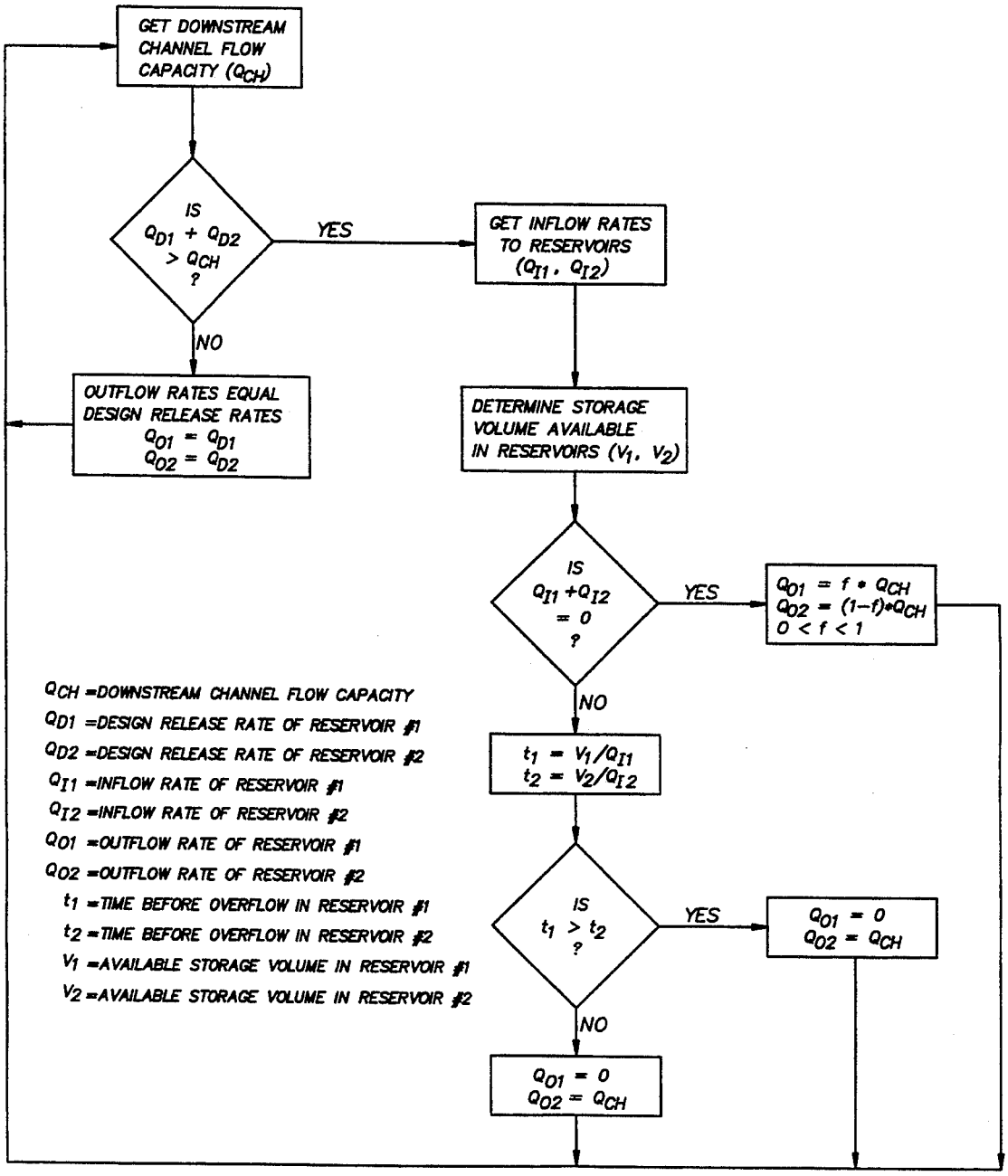

FIG. 15 is a logic diagram for routing stormwater from two reservoirs discharging into a common downstream channel with limited conveyance capacity.

Figure 16:
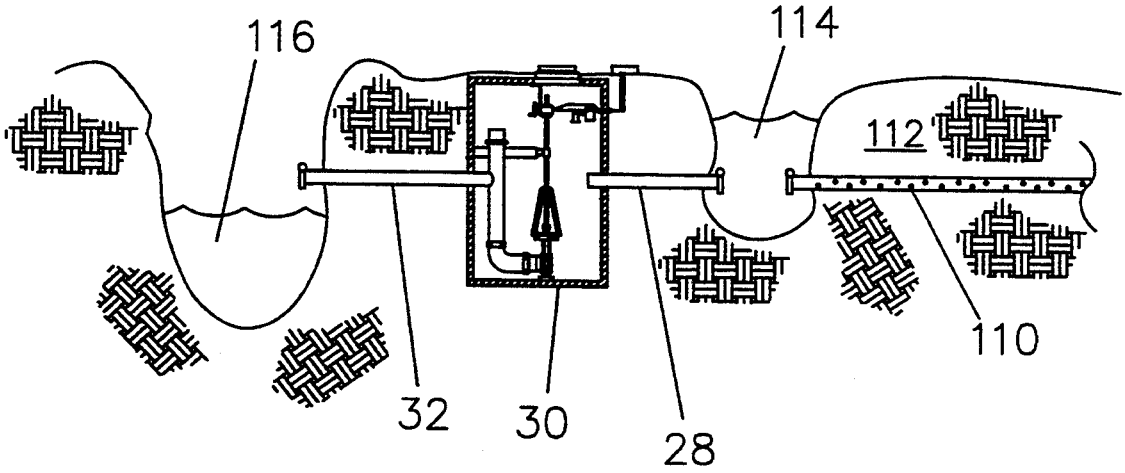

FIG. 16 is a profile view of a typical agricultural/forest drainage system and illustrates the use of the invention in the drainage system.

Figure 17:
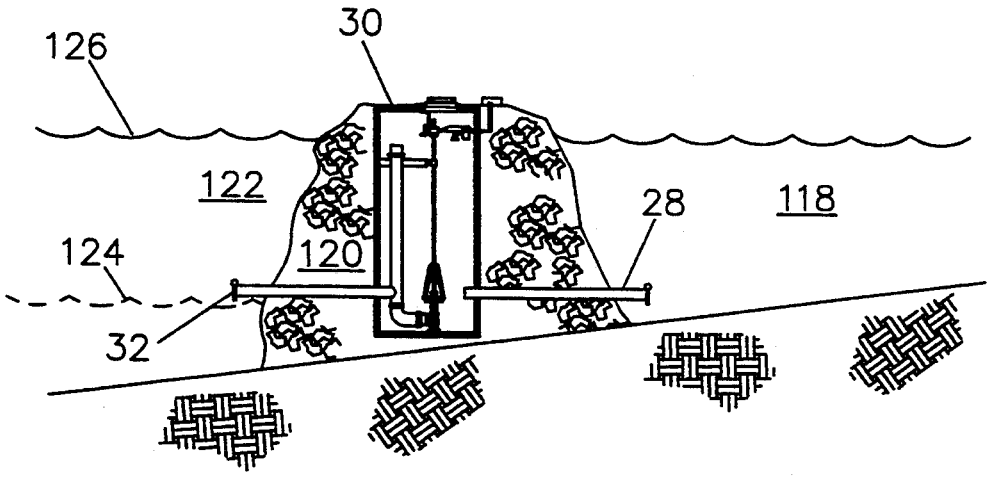

FIG. 17 is a profile view of a constructed tidal marsh and illustrates the use of the invention in the system and the range in tidal fluctuations.

Figure 18:
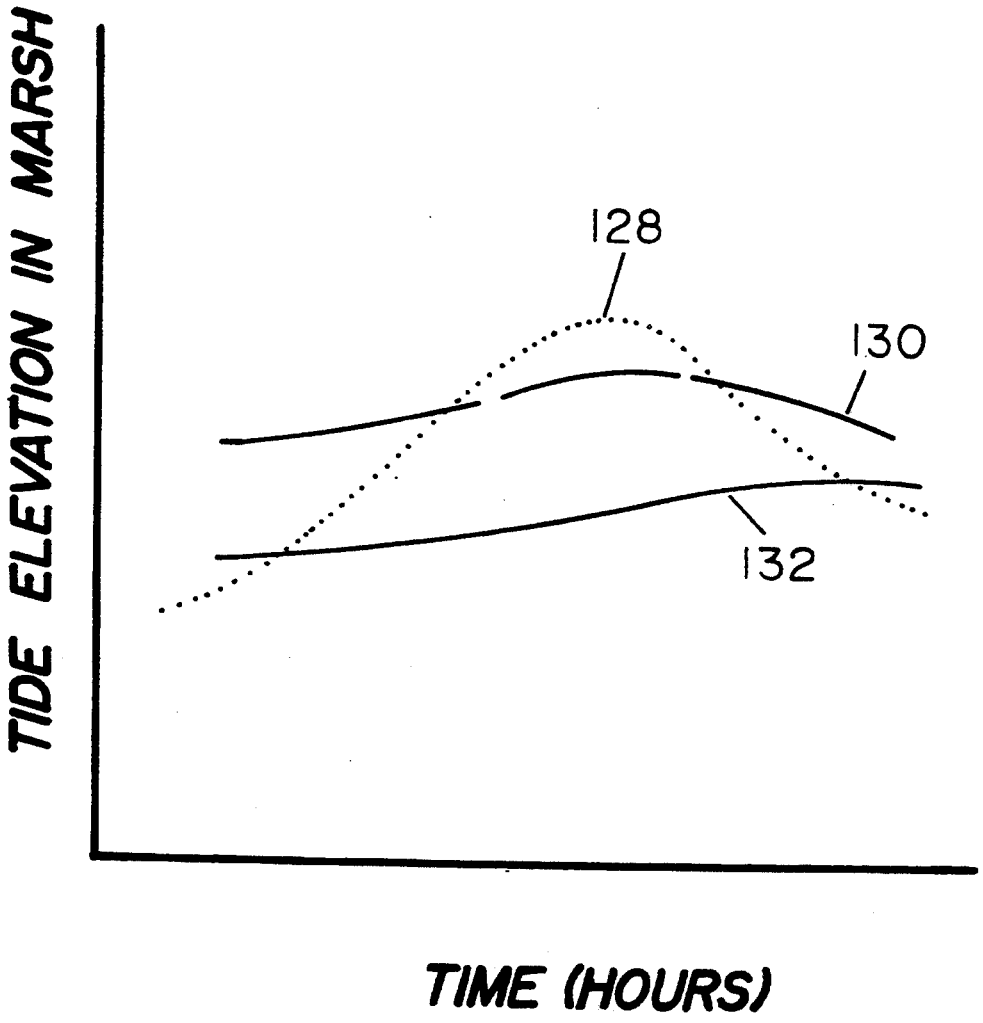

FIG. 18 is a graph illustrating the tidal fluctuations for a constructed tidal marsh under unregulated tidal conditions and under conditions regulated by the invention.

DETAILED DESCRIPTION OF THE PREFERRED EMBODIMENTS

Figure 3:
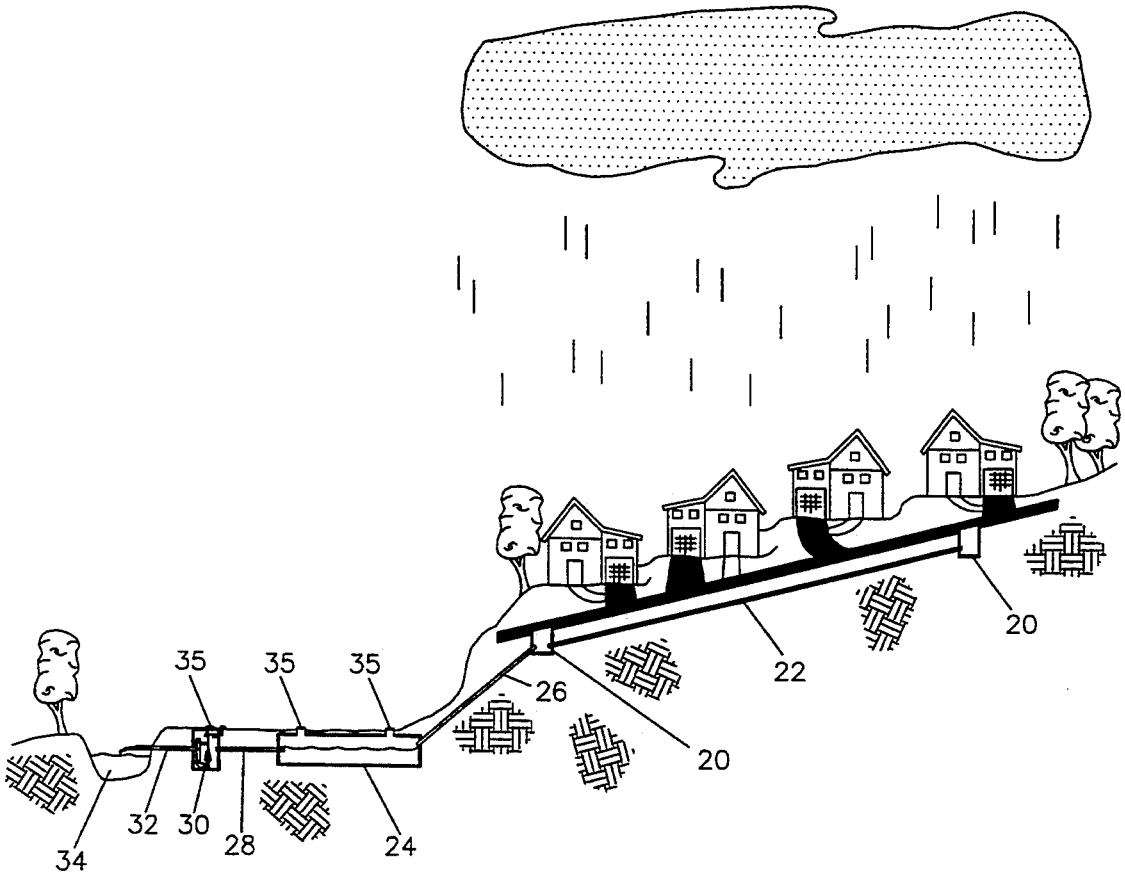
FIG. 3 is a schematic view of a developed watershed showing a system in which stormwater is collected, conveyed, detained and released to a downstream channel.
Figure 4:
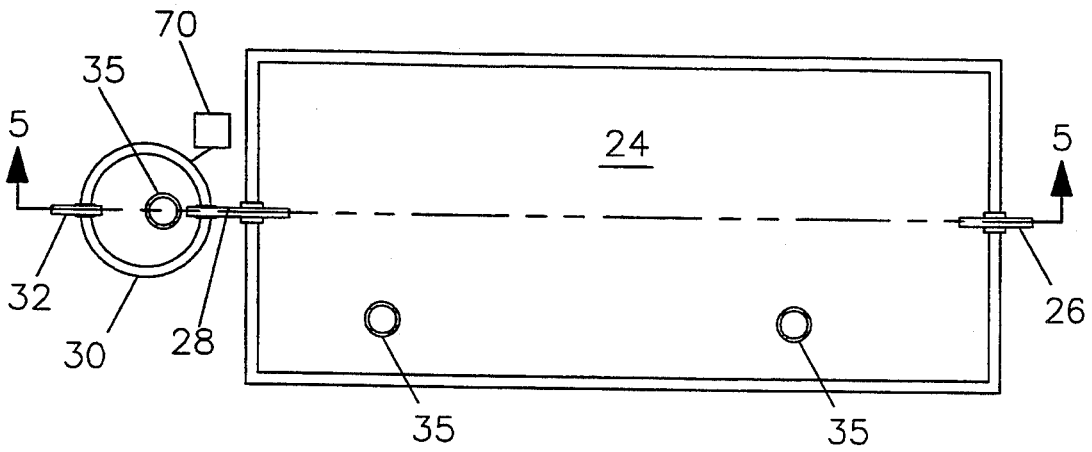
FIGS. 4 and 5 show plan and cross sectional views of a typical stormwater detention tank and a stormwater control system according to the invention, illustrating one application for the use of the invention.

Referring now to the drawings wherein like reference numerals designate identical or corresponding parts throughout the several views, and more particularly to FIGS. 3–5, stormwater from a watershed is collected by a series of interconnected catch basins 20 and is routed through a conveyance system 22. The stormwater enters a detention reservoir 24 through a reservoir inlet pipe 26 and is stored in the detention reservoir 24. A connector pipe 28 conveys the stormwater from the detention reservoir 24 to a control structure 30. Discharge from the detention reservoir 24 is regulated in the control structure 30. Stormwater leaves the control structure 30 through an outlet pipe 32 and is conveyed to a downstream system 34. Maintenance access to the detention reservoir and the control structure is provided by maintenance entrances 35.

The control structure 30 shown in FIG. 5, includes a flow restrictor mechanism, such as a gate valve 36, shown enlarged in FIG. 6, which regulates the outflow of stormwater from the system. Intowing stormwater in excess of the capacity of the detention reservoir 24 bypasses the flow restrictor mechanism 36 through an overflow outlet 38 when the water level rises above the level of the outlet 38 and exits the control structure 30 through the outlet pipe 32 to the downstream system 34.

The flow restrictor mechanism 36 is attached to a restrictor unit 40 by a fixed collar and gasket 42. The collar is sized to be easily installed on the restrictor unit 40. The gasket provides a watertight seal for the fitting. The restrictor unit 40 provides a structural platform for the flow restrictor mechanism 36, overflow outlet 38 and outlet pipe 32. The fixed collar and gasket 42 provide a means to attach the flow restrictor mechanism 36 to the restrictor unit 40. A bottom mount 44 securely fastens and supports the flow restrictor mechanism 36 within the control structure 30. The flow restrictor mechanism 36 regulates the discharge rate of liquid from the control structure 30 and detention reservoir 24. The flow restrictor mechanism 36 is mechanically adjustable by raising and lowering a drive stem 52. As shown in FIGS. 7–8, a valve body 46 encloses an adjustable gate 48. The gate 48 is connected to an actuator, such as an electric motor 50, by the drive stem 52. The electric motor 50 contains a position indicator to maintain the relative position of the gate 48 and thus the flow restrictor mechanism 36 flow area. The drive stem 52 passes through an offset yolk 54 which provides rigidity during operation of the gate 48 adjustment. A wall brace 56 provides guidance for the drive stem and additional support and rigidity for the flow restrictor mechanism 36. The offset yolk 54 and wall brace 56 each contain a bushing 58, through which the drive stem 52 passes. A gearing assembly inside the motor 50 operates on the stem threading 60, thus raising or lowering the drive stem 52, thereby adjusting the gate 48 position within the port opening 62 of the flow restrictor mechanism 36. A handwheel 64 is connected to the gearing assembly of the motor 50 to allow manual adjustment of the gate 48. A top brace 66 secures the motor 50 to the control structure.

The degree of closure of the gate 48 is determined by a signal sent from a position indicator on the electric motor 50 to a microcontroller 68. The motor 50 is controlled by instructions from the microcontroller 68 which precisely adjusts the flow restrictor mechanism 36. An electric utility box 70 provides housing for power connections to the motor 50 and the microcontroller 68. An actuator power cable 72 from the electric utility box 70 connects to the motor 50. A microcontroller power cable 74 from the electric utility box 70 connects to the microcontroller 68.

The microcontroller 68 is a digital/analog unit consisting of prior an components to perform digital control, automated analog measurement, equipment monitoring, switch monitoring, sensor monitoring, personal computer interface, telecommunication interface and data acquisition. The microcontroller 68, as such, is configured with the following features: CMOS microprocessor, RS-232 ports, on-board computer language interpreter, memory, on-board EPROM programmer, programmable counters/timers, external interrupts, printer interface, real-time calender clock, display module and interface and analog-digital converter. A power connection 76 as well as telecommunications and computer interface connections 78 are located on the body of the microcontroller 68. Instrument cables 80 and 80' connect the microcontroller to the motor 50 and to a sensor such as an ultrasonic water level sensor 82. Microprocessor programs for setting the flow restrictor mechanism 36 degree of closure are programmed into the microcontroller 68. The microprocessor programs incorporate the decision logic which allows the flow control system to meet various water management objectives for each particular installation as will be described below. The microcontroller 68 can be operated in three alternative modes including monitoring mode, interactive mode and hardwired mode.

When the microcontroller 68 operates in the monitoring mode, microprocessor programs use data based on external environmental parameters such as rainfall rate, rainfall amount, reservoir storage level or storage volume rate of change. The sensor measures the parameter of interest, such as reservoir storage level, and is monitored by the microcontroller 68. The microcontroller 68 interprets signals from the sensor, and based on the management objectives, selects the appropriate degree of closure for the flow restrictor mechanism 36 flow area which is mechanically set by the motor 50.

Generalized schematic representations of an alternative embodiment are shown in FIGS. 9–10, where the actuator 84 can be an electric motor, air, fluid or manually powered operator which controls a flow restrictor mechanism 86, which can be an adjustable gate, valve or orifice. As discussed above, control of the flow restrictor mechanism 86 is based upon microprocessor programs in a microcontroller 88. Real time environmental variables are measured with a sensor 90. The sensor 90 is monitored by the microcontroller 88. The sensor 90 may be a submerged pressure transducer, ultrasonic sensor, float and pulley/potentiometer sensor, dipping probe sensor, bubbler sensor, rain gauge, flow velocity meter, volumetric flow meter upstream or downstream from the reservoir, soil moisture meter or other such instrument for measuring environmental parameters.

Stormwater management objectives including constant discharge under variable hydraulic head, water quality improvement through increased detention time, reduced turbidity in stormwater exiting sedimentation ponds, improvement in the performance of existing undersized detention reservoirs, minimization of overflow from detention reservoirs, automated clearing of debris from the flow restrictor mechanism, flow data acquisition, stormwater routing, agricultural and forest drainage control, wetland hydroperiod and water level regulation and coastal marsh tidal fluctuation regulation are best accomplished with the microcontroller operating in the monitoring mode. A description of the method of accomplishing each of these stormwater management objectives follows.

Referring to FIGS. 4–8, to maintain constant discharge from the control structure 30 under variable hydraulic head (i.e. constant flow from the detention reservoir 24 for different reservoir storage levels), the sensor 82 is used to sense detention reservoir 24 storage level. The microcontroller 68 monitors the sensor 82 on a specified time interval and translates the signal from the sensor 82 into a detention reservoir 24 storage level depth, which is equated to hydraulic head on the port opening 62 of the gate valve 36. A microprocessor lookup table program determines the appropriate opening of the flow restrictor mechanism 36 to maintain the design release rate. The degree of the flow restrictor mechanism 36 opening is maintained in program memory of the microcontroller 68 or referenced directly from the flow restrictor mechanism 36 or motor 50 by an electronic position indicator. The required adjustment in the flow restrictor mechanism 36 flow area is determined by the microcontroller 68. A signal is sent from the microcontroller 68 to the motor 50 to adjust the flow restrictor mechanism 36 to the desired position. For example, when the rate of intowing stormwater to the detention reservoir 24 is greater than the design release rate, storage level in the detention reservoir 24 increases, thus increasing hydraulic head on the flow restrictor mechanism 36 port opening. The microcontroller 68 receives a signal from the sensor 82, indicating a change in storage level and determines the new smaller required opening of the flow restrictor mechanism 36. The microcontroller 68 then sends a signal to the motor 50 to physically set the flow restrictor mechanism 36 to the required opening to maintain the outflow through the outlet pipe 32 at the design release rate. A logic diagram for flow rate control from the detention reservoir 24 is illustrated in FIG. 11.

To improve water quality through increased detention time of stormwater, the sensor 82 is used to sense conditions indicative of detention reservoir 24 storage level and storage level rate of change. In FIG. 6, the ultrasonic water level sensor 82 can be used to measure reservoir storage level. Measurements taken over time can be used to measure storage level rate of change. Computer programs for maximizing detention time and therefore increasing settling of suspended solids, can be adopted on a site specific basis having knowledge of the watershed's hydrograph characteristics in response to rainfall events. The rate of change of storage level can be used to indicate the start and end of storm events. The microcontroller 68 monitors the sensor 82. The start of a rainfall event is indicated by a change in reservoir storage level as measured by the sensor 82. The microcontroller 68 operates a program which determines available storage volume in the detention reservoir 24. If adequate storage volume exists, the microcontroller 68 sends a signal to the motor 50 to close the flow restrictor mechanism 36. If the intowing stormwater ceases, as indicated by the change in detention reservoir 24 storage level, before a predetermined extended detention storage level is reached, the flow restrictor mechanism 36 remains closed until either a predetermined detention time has passed or intowing stormwater once again begins and the extended detention storage level is reached. The extended detention storage level is determined analytically by hydrologic simulation or through field testing. The extended storage level is intended to provide adequate storage volume for intowing stormwater in addition to that volume of stormwater which is being detained for an extended period. When the extended detention storage level is reached with the flow restrictor mechanism 36 in the closed position, the microcontroller 68 sends a signal to the motor 50 to open the flow restrictor mechanism 36 to discharge stormwater. The management objective is to discharge stormwater at a rate which will maximize detention time but not create reservoir overflow. A logic diagram for controlling stormwater detention time is illustrated in FIG. 11.

An alternative method of sensing the characteristics of a rainfall event is to use an electronic rainfall gauge as a sensor. The rainfall gauge senses the onset, cessation, rate and amount of rainfall. With knowledge of the water yield characteristics of the watershed, the microcontroller 68 can be programmed to calculate the anticipated intowing hydrograph of the rainfall to the detention reservoir 24. This process of predicting intowing hydrographs is routinely followed in designing stormwater detention reservoirs with analytical methods such as the Soil Conservation Service hydrograph method or the Santa Barbara Urban Hydrograph analysis method. With an estimate of the intowing hydrograph, the microcontroller 68 can adjust the flow restrictor mechanism 36 to optimize detention time of intowing stormwater.

To reduce the turbidity of the stormwater exiting from sedimentation ponds, methods similar to those for increasing water quality through increased detention time are employed. The reservoir storage depth at which the flow restrictor mechanism 36 is allowed to remain in the closed position and desired detention times may vary depending upon the characteristics of the suspended solids. For instance, longer detention time would be required for sealing freer or less dense suspended solids. As an alternative to detention time as a measure of water quality improvement, a turbidity meter could be used as a sensor, monitored by the microcontroller 68. The turbidity meter would indicate when the turbidity of the detained stormwater is reduced to a desired level and thus could be released from the detention reservoir 24. The release of stormwater from sedimentation ponds can be controlled interactively on a day to day basis, thus allowing weather forecasts to be used to advantage in providing maximum detention. The weather forecast could be used to maximize detention time of the stormwater with decreased risk of detention reservoir 24 overflow. If, for example, no rainfall is anticipated to occur for the next several days, stormwater could be detained with low risk of detention reservoir 24 overflow. However, if rainfall is anticipated to occur in the near future, stormwater currently being detained in the detention reservoir 24 may best be released from the reservoir 24 to provide storage volume for expected stormwater inflow.

To improve the performance of existing undersized stormwater detention reservoirs, the flow control system is retrofitted to the control structure 30 of the existing reservoir 24. Methods to maintain constant discharge from the control structure 30 under variable head, as discussed above, are employed. This increases the effective storage volume of the existing reservoir 24 by making better use of the available storage volume. In addition, methods to increase detention time, as discussed above, can be utilized to improve stormwater quality discharged from systems which may have no provisions for water quality treatment.

Figure 1:
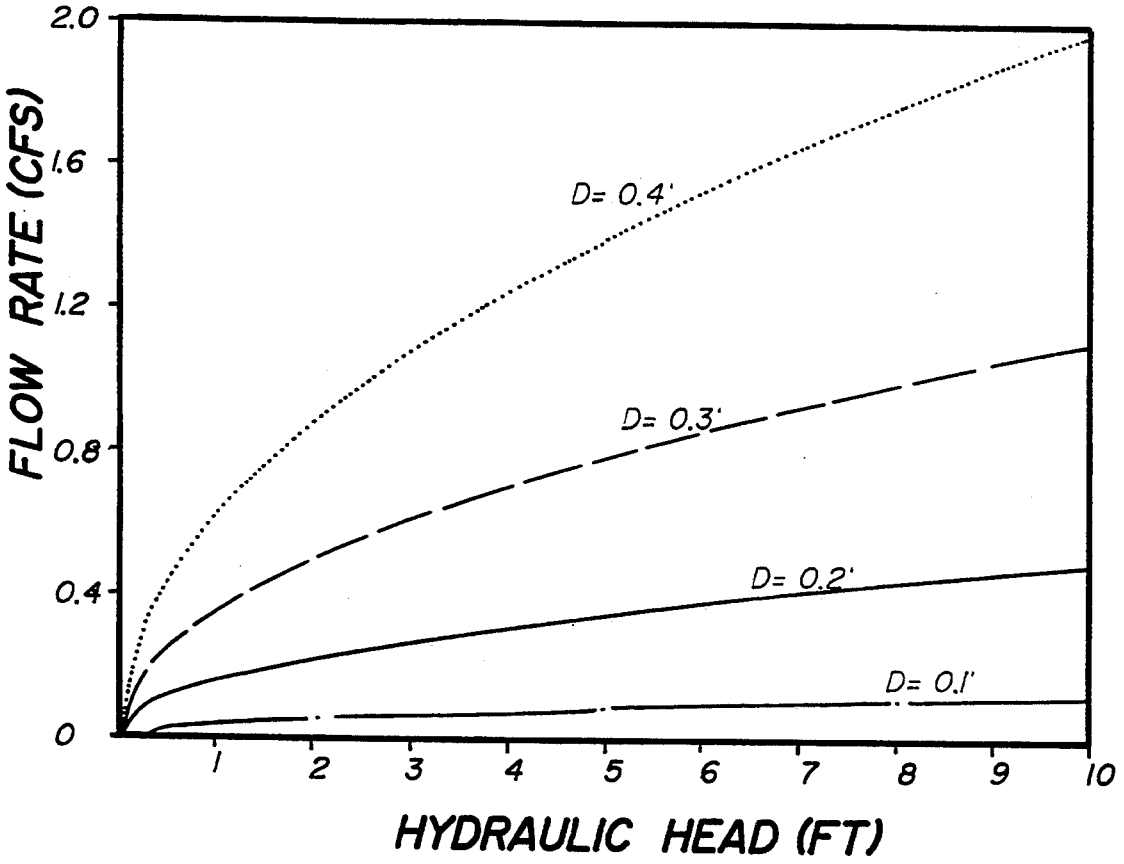
FIG. 1 is a graph illustrating the relationship between hydraulic head on a fixed placement flow restrictor and the resulting flow rate through the mechanism. The relationship is shown for four different diameter orifices, each for hydraulic heads ranging from 0.0′ to 10.0′.
Figure 2:
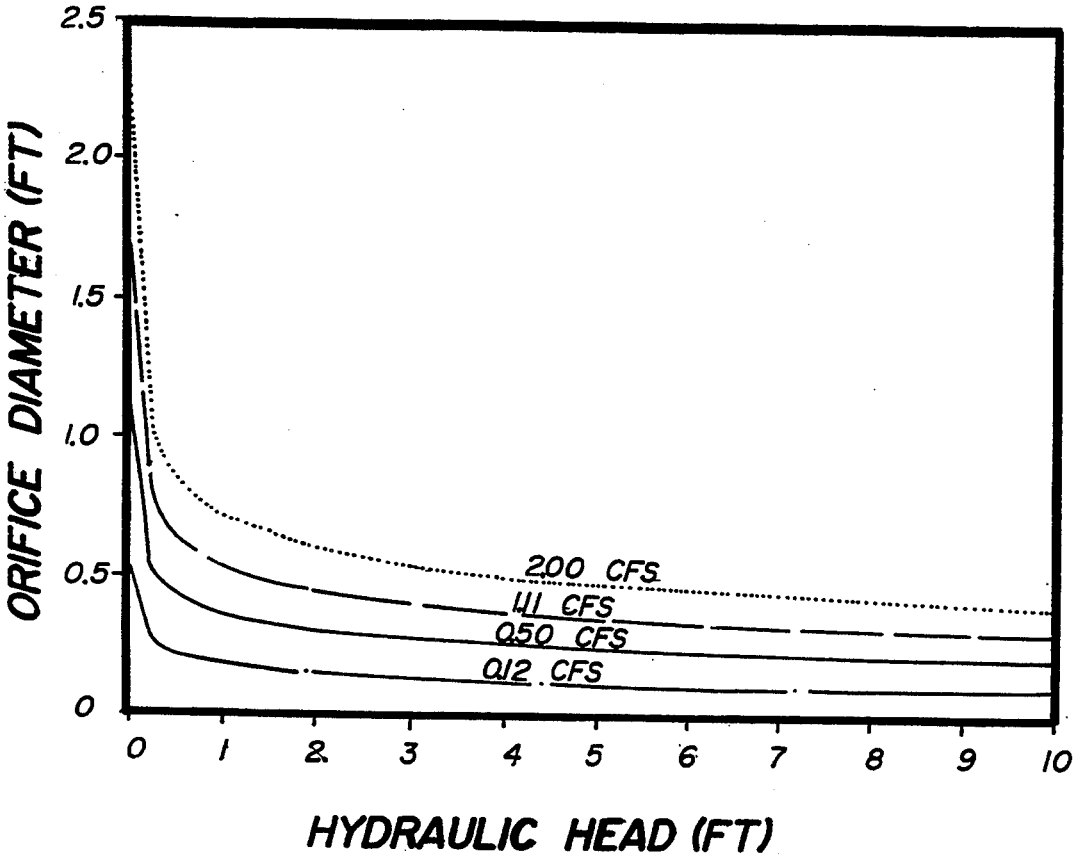
FIG. 2 is a graph illustrating the orifice diameter required to maintain a constant discharge rate from a flow restrictor mechanism under variable hydraulic head. Four different flow rates are presented for hydraulic heads ranging from 0.0′ to 10.0′.

To minimize overflow from the detention reservoir 24, the sensor 82 is used to sense conditions indicative of detention reservoir 24 storage level and storage level rate of change. The microcontroller 68 monitors the sensor 82 for indication when the reservoir 24 store level is at a predetermined warning level below the overflow outlet 38. When this warning level occurs and the rate of stormwater inflow is greater than the rate of stormwater outflow, the microcontroller 68 sends a signal to the motor 50 to incrementally increase the flow restrictor mechanism 36 flow area to a setting which increases flow above the design release rate but at a rate less than would occur with overflow. The rate of stormwater outflow is calculated with the relationship between the hydraulic head on the flow restrictor mechanism 36 and flow area. When the detention reservoir 24 storage level has drained back down to below the warning level, as indicated by the sensor 82, the microcontroller 68 instructs the motor 50 to adjust the flow restrictor mechanism 36 such that the design flow ram is resumed. A logic diagram for minimizing overflow from the detention reservoir 24 is illustrated in FIG. 1.

To provide automated clearing of debris from the flow restrictor mechanism 36, one or more sensors are used to sense conditions indicative of a clogged flow restrictor. This is accomplished with independent sensors to measure the storage level in the reservoir 24 and the rate of intowing stormwater. If, for instance, over a time interval the storage level of the reservoir 24, as measured by the ultrasonic water level sensor 82, does not change by the differential amount of the inflow rate as measured by a flow meter at the detention reservoir inlet pipe 26 and the calculated outflow rate as determined by the flow restrictor mechanism 36 flow area, then this indicates that the flow restrictor mechanism 36 is clogged. Upon receiving a signal that indicates debris blocking the flow restrictor mechanism 36, the microcontroller 68 sends instructions to the motor 50 to oscillate the flow restrictor mechanism 36 between open and closed positions to dislodge the debris. A logic diagram for automated clearing of debris is shown in FIG. 12.

To acquire flow data, which can be used to evaluate and fine-tone the performance of the flow restrictor mechanism 36 and microcontroller 68 logic, a sensor is used to sense conditions indicative of one or more of the following: detention reservoir 24 storage level, flow rate leaving the detention reservoir 24, flow rate entering the detention reservoir 24 and rainfall. The ultrasonic sensor 82 can be used to directly measure detention reservoir 24 storage level. The relationship between reservoir storage level and flow restrictor mechanism 36 flow area can be used to calculate outflow rate from the reservoir 24. The detention reservoir storage level measured over time along with the relationship between reservoir storage level and reservoir storage volume can be used to calculate inflow rate to the detention reservoir 24. Alteratively, a flow meter in the inlet pipe 26 to the detention reservoir 24 can be used to directly measure inflow rate. An electronic rainfall gauge can be used to measure rainfall, which is useful to evaluate the performance of the system. The microcontroller 68 monitors the sensors and records the signals in microcontroller 68 program memory at a specified time interval. The collected data can be used by computer programs to automatically evaluate stormwater management performance and adjust the design of the flow restrictor mechanism 36. A logic diagram for data collection and automated evaluation and adjustment of the stormwater system is illustrated in FIG. 13. As an alternative to automated analysis and adjustment, the microcontroller 68 can be linked to a personal computer and the data downloaded and separately analyzed in an interactive mode.

To optimize stormwater routing within a region comprised of at least one detention reservoir with discharge controlled by the flow control system, a sensor is used to sense conditions indicative of storage level of the detention reservoir, storage level ram of change, discharge rate from the detention reservoir and available downstream conveyance capacity. An example where stormwater from two managed watersheds contribute to the same downstream system is illustrated in FIG. 14. Stormwater collected from a watershed is conveyed by a pipe 91 to a below ground detention reservoir 92. Stormwater collected from a second watershed is conveyed by a pipe 93 to an above ground detention reservoir 94. Control structures 96 and 98 embody separate flow control systems consisting of the previously described flow restrictor mechanism 36, motor 50, sensor 82 and microcontroller 68. A central controller 100 links flow control system microcontrollers either by direct cable or telecommunications linkage 102. Either the microcontroller in the control structure 96 of the below ground detention reservoir 92 or the control structure 98 of the above ground detention reservoir 94 could be configured to be the central controller 100. In this example, the microcontroller in the control structure 98 regulating discharge from the above ground detention reservoir 94 is configured to be the central controller 100. The central controller 100 schedules stormwater release from the individual reservoirs 92 and 94 in a manner such that efficient use is made of the conveyance capacity of the downstream system 104. A sensor such as a float and pulley/potentiometer 108 indicating available downstream conveyance capacity is linked to the centralscontroller 100 either by direct cable 106 or telecommunications linkage. The central controller 100 determines available conveyance capacity of the downstream system 104. The maximum conveyance of the downstream system is limited by the hydraulic capacity of the channel. The available conveyance capacity of the downstream system is the difference between the maximum conveyance and the current conveyance. The current conveyance is predicted knowing the channel water level as measured with the downstream water level sensor 108. Commonly applied channel flow equations are used to develop the relationship between channel water level and conveyance. If the discharge from the contributing detention reservoirs 92 and 94 is greater than the available conveyance capacity of the downstream system 104 then the central. controller 100 prioritizes discharge from the detention reservoirs 92 and 94. For instance, a detention reservoir 92 or 94 near capacity with intowing stormwater has higher -priority for discharge than a detention reservoir 92 or 94 near capacity without intowing stormwater or a detention reservoir 92 or 94 not near capacity with intowing stormwater. To control stormwater discharge, the central controller 100 sends instructions to the microcontroller regulating the discharge from the individual detention reservoirs 92 and 94. The instructions dictate the allowed discharge rate from the detention reservoirs 92 and 94 for the current flow conditions. The instructions are processed by each microcontroller which relays instructions to the motor 50 to adjust the flow restrictor mechanism 36 accordingly for the desired flow rate. A logic diagram for stormwater routing is illustrated in FIG. 15.

An agricultural or forest drainage system is illustrated in FIG. 16, where parallel drainage ditches or subsurface drains 110 remove excess water from a crop growing area 112. A collector ditch or drainage pipe network 114 collects and routes drainage through a connector pipe 28 to the flow control structure 30. The flow control structure 30 regulates water level in the collector ditch 114 and therefore water table level in the crop growing area 112. Water released through the control structure 30 is discharged through the outlet pipe 32 to an outlet ditch 116. The flow control system can be programmed to meet a variety of water management objectives which may be directed at improving soil moisture conditions for plant growth and machine operations or minimizing offsite impacts from surface water runoff.

To regulate the hydroperiod and water levels in constructed wetlands the control structure 30 is located at the inlet or outlet of the wetland. The ultrasonic sensor 82 is used to sense conditions indicative of wetland water level or water level rate of change. The microcontroller 68 monitors the sensor 82 on a predetermined time interval. A microprocessor program compares the current wetland water level to the water level which is required to maintain a desired hydroperiod. The microcontroller 68 sends instructions to the motor 50 to adjust the flow restrictor mechanism 36 in a manner such that the wetland water level is controlled to match the desired hydroperiod as closely as possible. For example, if a constructed wetland has a stream intowing at a constant rate, fluctuations in wetland water level can be created by controlling the outflow rate from the control structure on a time schedule. In contrast, if a wetland has a stream intowing at a variable rate, fluctuations in wetland water level can be minimized by controlling the outflow rate from the wetland relative to the wetland water level and water level rate of change as measured by the sensor 82.

The flow control system can be used to manage tidal fluctuations in coastal marshes in a manner similar to that used in regulating wetland hydroperiod. A primary difference is that, in the coastal marsh, the flow control structure 30 becomes both the inflow and outflow regulator of the marsh according to whether the tide is in flood or ebb stage. A design for a tidal marsh 118 constructed in a natural inlet to existing shoreline is illustrated in FIG. 17. A constructed seawall 120, built between the tidal body of water 122 and the tidal marsh area 118 contains the control structure 30. The control structure 30 regulates tidal marsh outflow through the control structure outlet 32 and tidal marsh inflow through the control structure inlet 28. The system allows the tidal marsh water level to be maintained at any desired level between the elevation of low tide 124 and the elevation of high tide 126. By synchronizing tidal marsh inflow with high tides and outflow with low tides, tidal fluctuations, marsh water levels and hydroperiod can be controlled. The tidal fluctuations under unregulated conditions and under the regulation of the current invention are illustrated in FIG. 18. Natural tidal fluctuations 128 can be regulated to produce tidal fluctuations characteristic of a low marsh ecosystem 130 or a high marsh ecosystem 132. Restricting inflow to the tidal marsh during flood tide reduces peak water levels in the marsh. Restricting outflow from the tidal marsh during ebb tide increases water levels in the wetland over natural conditions. Such control over tidal fluctuations can be critical in controlling the marsh hydroperiod for the establishment and success of a desired type of ecosystem.

As previously discussed, the microcontroller 68 can be programmed to operate in an interactive mode. This mode of operation is useful for design adjustments of the flow restrictor mechanism and control logic. The RS-232 port 78 and supporting software allow a personal computer to interface with the microcontroller 68. Data such as reservoir inflow rate, outflow rate, storage level and rainfall amounts measured with previously described sensors and stored in memory of the microcontroller 68 can be analyzed with personal computer software to evaluate the performance of the system. Necessary adjustments to improve performance can be made interactively with personal computer software which modifies the operation of the microcontroller 68. For instance, if upon evaluation of the collected dam, it is evident that reservoir storage volume is undemtilized, even for large storms, then flow rates from the detention reservoir 24 can be reduced and detention time increased to improve management of the stormwater. Or, in contrast, if the collected data shows overflow from the reservoir occurred several times, then this indicates that the logic controlling detention time and/or overflow minimization needs to be modified.

Lastly, the microcontroller 68 can be programmed to operate in a hardwired mode. In this mode of operation, the microprocessor programs base flow control on real-time scheduled calender events or programmed instructions independent of external environmental conditions. This may include instructions to adapt the stormwater detention reservoir into an irrigation source for lawn and landscaped areas on a seasonal basis by closing down the flow restrictor mechanism 36, when irrigation demands are high.

Numerous modifications and variations of the present invention are possible in light of the above teachings. It is therefore to be understood that within the scope of the appended claims, the invention may be practiced otherwise than as specifically described therein.

I claim:

1. A stormwater flow control system, comprising:

at least one stormwater detention reservoir;

an outflow conduit from said stormwater detention reservoir for conveying water from said stormwater detention reservoir to a runoff channel;

an adjustable flow restrictor mechanism in said outflow conduit for controlling the flow rate through said outflow conduit, said flow restrictor mechanism having an adjustable opening through which water can flow from said detention reservoir to said runoff channel;

an actuator connected to said adjustable flow restrictor for adjusting said opening size in said adjustable flow restrictor mechanism to any of a multitude of possible positions between fully opened and fully closed to achieve the desired optimal flow rate out of the detention reservoir;

at least one sensor for sensing conditions indicative of stormwater inflow to said stormwater detention reservoir;

a microcontroller programmed to produce signals in response to signals from said sensor and an internal program to control said actuator to adjust said flow restrictor mechanism to release stormwater from said stormwater detention reservoir at an optimal rate under said conditions.

2. A stormwater flow control system as defined in claim 1, wherein:

said adjustable flow restrictor mechanism includes a gate valve; and said actuator includes an electric motor connected through a reduction gearing to a drive stem which is coupled to said gate valve for controlling the position of gate in said valve, said motor having a position indicator to indicate the relative position of the gate in said valve for providing feedback of said gate position to said microcontroller.

3. A stormwater flow control system as defined in claim 1, wherein:

said sensor includes a water level sensor for detecting the water level in said reservoir.

4. A stormwater flow control system as defined in claim 1, wherein:

said sensor includes at least one volumetric flow rate sensor in a conveyance structure upstream from said reservoir;

whereby said microcontroller utilizes data from said sensor to predict an increase in the inflow rate to said reservoir and adjust said flow restrictor mechanism to increase the outflow rate from said reservoir in anticipation of said increased inflow rate.

5. A stormwater runoff control system as defined in claim 1, further comprising:

at least one additional stormwater detention reservoir.

6. A stormwater runoff control system as defined in claim 5, further comprising:

a central computer;

communication links for linking said microcontrollers at each of said additional stormwater detention reservoirs;

means in said central computer for determining the total discharge from all of said stormwater detention reservoirs and comparing said total discharge to the available conveyance capacity of the downstream conveyance system;

means in said central computer for prioritizing said stormwater detention reservoirs according to anticipated time of reaching an overflow condition and for signaling the one reservoir anticipated to first reach an overflow condition to increase the outflow therefrom to prevent the anticipated overflow condition.

7. A stormwater runoff control system as defined in claim 6, further comprising:

means in said central computer for signaling the reservoirs other than said one reservoir to reduce the outflow therefrom in the event that the increased outflow from said one reservoir would increase the total outflow from all reservoirs above the total capacity of said downstream conveyance system.

8. A method of managing stormwater runoff from a watershed, comprising:

conveying said stormwater into at least one stormwater detention reservoir;

sensing the available capacity in said reservoir;

controlling the rate at which stormwater flows out of said reservoir at any desired rate between maximum flow rate and zero flow rate to maximize the settling time to reduce turbidity, and to minimize the risks of water outflow from said reservoir at rates exceeding the capacity of runoff channels downstream of said reservoir.

9. A method as defined in claim 8, wherein:

said controlling step includes adjusting a flow restrictor mechanism in an outflow conduit from said reservoir.

10. A method as defined in claim 8, further comprising:

sensing the stormwater flow rate in said watershed upstream of said reservoir as an indication of anticipated increased stormwater inflow rate into said reservoir in the near future;

adjusting the flow restrictor mechanism to increase the flow rate out of said reservoir in anticipation of said increased inflow rate.

11. A method as defined in claim 8, wherein said conveying step includes:

conveying said stormwater runoff from said watershed to a plurality of reservoirs;

said available storage capacity is sensed in each of said reservoirs;

further comprising determining the rate of change of the liquid level in each of said reservoirs;

calculating, at said determined rates of change, which will be the first reservoir to reach its capacity;

further controlling said stormwater outflow rate in said first reservoir to postpone the filling of said reservoir to capacity.

12. A method as defined in claim 9, wherein:

said adjusting step is performed by an electric motor under control of a microcontroller operating in accordance with an internal program with inputs of said available capacity in said reservoir.

13. A flow control system for controlling stormwater discharge from a detention reservoir, comprising:

a flow restrictor mechanism with variable flow area in an outlet conduit from said detention reservoir for controlling the volumetric flow rate out of said reservoir;

an actuator coupled to said variable flow restrictor mechanism for controlled adjustment of the flow area of said flow restrictor mechanism to any desired position between fully opened and fully closed for controlling stormwater discharge from the detention reservoir at any desired flow rate within the flow capacity of said flow restrictor mechanism;

at least one sensor for sensing conditions having relevance to the desired release rates from said detention reservoir;

a programmable microcontroller having means to produce signals to automatically control operation of said actuator in response to signals received from said sensor.

14. A system as defined in claim 13, wherein:

said sensor senses conditions indicative of the rate at which stormwater is flowing into said reservoir and the available storage capacity in said reservoir;

said microcontroller having means to automatically send signals to said actuator and control the rate of stormwater discharge from said reservoir to maximize the settling time to improve water quality, while minimizing the risks of reservoir overflow;

whereby stormwater quality exiting from said stormwater detention reservoir is improved through increased detention time.

15. A system as defined in claim 13, wherein:

said sensor senses conditions indicative of the rate at which stormwater is flowing into said reservoir and the available storage capacity in said reservoir;

said microcontroller having means for automatically controlling said flow restrictor mechanism such that first-flush and low volume storms are detained for a predetermined length of time, while minimizing the risks of reservoir overflow.

16. A system as defined in claim 13, wherein:

said sensor senses the available storage capacity of said reservoir;

said microcontroller having means for producing signals in response to signals from said sensor to adjust said flow restrictor mechanism to restrict stormwater outflow on a seasonal basis such that stormwater will be available in said reservoir for pumping to lawn and landscaped areas during the season irrigation water is needed.

17. A system as defined in claim 13, wherein:

said sensor senses conditions indicative of detention reservoir storage level and discharge rate from the detention reservoir;

said microcontroller having means for monitoring said sensor and storing sensor readings in memory at a specified time interval;

whereby the system can acquire flow data and detention reservoir storage level data over time for purposes of planning stormwater management improvements in the future.

18. A system as defined in claim 13, wherein:

said sensor senses conditions indicative of detention reservoir storage level and discharge rate from the detention reservoir;

said microcontroller having means for monitoring said sensor and storing sensor readings in memory at a specified time interval;

said microcontroller having means for downloading collected data to a personal computer for analysis;

said microcontroller having means for interactively adjusting stormwater system parameters used in managing stormwater to better attain the desired stormwater management performance.

19. A system as defined in claim 13, wherein:

said sensor senses conditions indicative of detention reservoir storage level and discharge rate from the detention reservoir;

said microcontroller having means for monitoring said sensor and storing sensor readings in memory at a specified time interval;

said microcontroller having means for periodically evaluating collected data and comparing actual stormwater management performance to desired performance and automatically adjusting stormwater system parameters in managing stormwater to better attain the desired performance.

20. A system as defined in claim 13, wherein:

said sensor senses conditions indicative of hydraulic head on said flow restrictor mechanism;

said microcontroller having means for instructing said actuator to adjust said flow restrictor mechanism flow area such that a constant flow rate occurs from said detention reservoir for all storage levels;

whereby the system provides constant discharge from said detention reservoir under conditions of variable hydraulic head on said flow restrictor mechanism, thereby minimizing required storage volume in said detention reservoir.

21. A system as defined in claim 13, retrofitted to an existing stormwater detention reservoir, wherein:

said sensor senses conditions indicative of the rate at which stormwater is flowing into said reservoir and the available storage capacity in said reservoir;

said sensor senses conditions indicative of hydraulic head on said flow restrictor mechanism;

said microcontroller having means to automatically send signals to said actuator and control the rate of stormwater discharge from said reservoir to maximize the settling time to improve water quality, while minimizing the risks of reservoir overflow;

said microcontroller having means for instructing said actuator to adjust said flow restrictor mechanism flow area such that a constant flow rate occurs from said detention reservoir for all storage levels;

whereby the system improves the performance of existing stormwater detention reservoirs by improving water quality and increasing effective storage volume.

22. A system as defined in claim 13, wherein:

said sensor senses conditions indicative of detention reservoir storage level and rate of inflowing stormwater;

said microcontroller having means for instructing said actuator to adjust said flow restrictor mechanism such that when a predetermined storage level occurs concurrently with inflowing stormwater an increase in outflow rate is produced by instructing said actuator to adjust said flow restrictor mechanism accordingly;

whereby the system minimizes overflow from said detention reservoir.

23. A system as defined in claim 13, wherein:

said sensor senses conditions indicative of the rate of inflowing stormwater;

said microcontroller having means for identifying conditions in which the flow restrictor is blocked by debris and subsequently instructing said actuator to oscillate said flow restrictor mechanism between open and closed positions;

said microcontroller having means for instructing said actuator to oscillate said flow restrictor mechanism between open and closed positions based on a calendar schedule;

whereby the system automatically clears debris from said flow restrictor mechanism.

24. A system as defined in claim 13, wherein:

said sensor senses conditions indicative of water table level or soil moisture conditions of forest or agricultural land;

said microcontroller having means for instructing said actuator to adjust said flow restrictor mechanism such that the water table level is maintained at a predetermined desired position;

whereby the system provides automated control over drainage from agricultural and forest land.

25. A system as defined in claim 13, wherein:

said sensor senses conditions indicative of hydroperiod or water level in a constructed or upgraded wetland;

said microcontroller having means for instructing said actuator to adjust said flow restrictor mechanism to control water outflow from or inflow to a wetland in effort to regulate said hydroperiod and manage said water level in a controlled manner.

26. A system as defined in claim 13, wherein:

said sensor senses conditions indicative of hydroperiod of water level in a constructed or upgraded wetland or marsh where tidal fluctuations are a hydrologic feature;

a second sensor senses conditions indicative of tidal level;

said microcontroller having means for instructing said actuator to adjust said flow restrictor mechanism to control tidal fluctuations in said tidal marsh, thereby regulating hydroperiod and water levels in said tidal marsh.

* * * * *